224-179 SR
6/10/86 OR 4,593,842

United States Patent [19]
Koenuma

[11] Patent Number: 4,593,842
[45] Date of Patent: Jun. 10, 1986

[54] WATCH BAND

[75] Inventor: Sukeo Koenuma, Tanashi, Japan

[73] Assignee: Citizen Watch Co., Ltd., Tokyo, Japan

[21] Appl. No.: 671,950

[22] Filed: Nov. 16, 1984

[51] Int. Cl.[4] ..... A44C 5/12
[52] U.S. Cl. ..... 224/179; 224/164
[58] Field of Search ..... 224/164–179; 63/3–7; 24/265; 368/282; D11/4

[56] References Cited

U.S. PATENT DOCUMENTS

| | | | |
|---|---|---|---|
| 2,528,185 | 10/1950 | Speck | 63/4 X |
| 2,761,600 | 9/1956 | Ritter et al. | 63/3 X |
| 2,871,655 | 2/1959 | O'Larte et al. | 224/176 X |
| 2,937,798 | 5/1960 | Morf | D11/4 X |
| 2,998,697 | 9/1961 | Augenstein | 63/3 X |
| 3,398,523 | 8/1968 | Meng | 63/4 X |
| 3,902,313 | 9/1975 | Poon | 63/4 X |

*Primary Examiner*—Stephen Marcus
*Assistant Examiner*—Robert Petrik
*Attorney, Agent, or Firm*—Birch, Stewart, Kolasch & Birch

[57] ABSTRACT

A watch band having a plurality of links, and a plurality of connecting links for connecting the links with each other. Each connecting link comprises a plate member and a connecting block, and the plate member is secured to the connecting block. Adjacent links are connected by engaging pins with the corresponding holes of the links and the connecting block. The plate member is so arranged that the surface thereof is exposed between adjacent links.

10 Claims, 8 Drawing Figures

WATCH BAND

BACKGROUND OF THE INVENTION

The present invention relates to a band for a wristwatch, and more particularly to a band comprising a plurality of links of metal, adjacent links of which are connected with each other by a metallic connecting link and pins.

Generally, a metallic watch band comprises a plurality of rectangular links each having a constant width in the lengthwise direction of the band and connecting members are hidden by the links. Accordingly, the watch band has a simple appearance. Further, it is difficult to make a watch band in which adjacent links are different in width.

SUMMARY OF THE INVENTION

An object of the present invention is to provide a watch band comprising a plurality of links, and a plurality of connecting links, each connecting link being so arranged that the surface thereof is disposed between adjacent links to be exposed, whereby a watch band comprising links having different widths may be provided.

Another object of the present invention is to provide a watch band in which each link has an arcuate quadrate shape in plan view.

A further object of the present invention is to provide a watch band the appearance of which can be easily changed into various patterns.

According to the present invention, there is provided a watch band having a plurality of links, and a plurality of connecting links for connecting the links with each other, characterized in that each link has a recess at the underside thereof, each connecting link comprises a plate member and a connecting block which is engaged with the recess of the link, the plate member is secured to the connecting block at a central portion with respect to the lengthwise direction of the band. The link and connecting block have a pair of holes at both sides thereof, the holes of the connecting block are so disposed to correspond to holes of adjacent links. Adjacent links are connected by engaging pins with the corresponding holes of the links and the connecting block, the plate member being so arranged that the surface thereof is exposed between adjacent links.

In one embodiment of the present invention, each of the links and plate members has a semicircular shape, and in another embodiment each of the links and plate members has an arcuate quadrate surface.

These and other objects and features of the present invention will become more apparent from the following description with reference to the accompanying drawings.

BRIEF DESCRIPTION OF THE DRAWIGNS

Figure 4A:
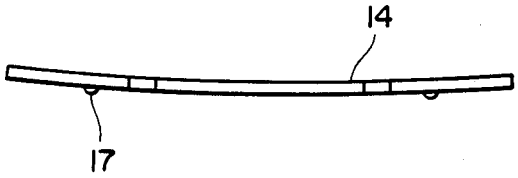
Figure 4B:
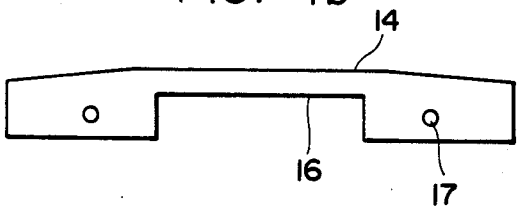
Figure 5:
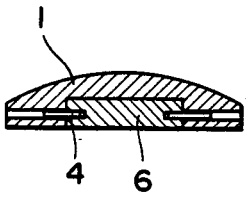
Figure 6:
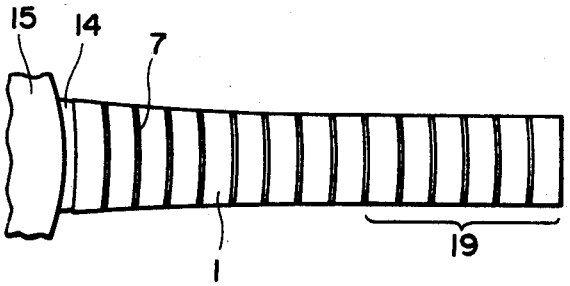

FIG. 4*a* is a plan view of an end plate of the band;

FIG. 4*b* is a side view of the end plate of FIG. 4*a*;

FIG. 5 is a cross sectional view of the band;

FIG. 6 is a plan view showing a part of the watch band; and

Figure 7:
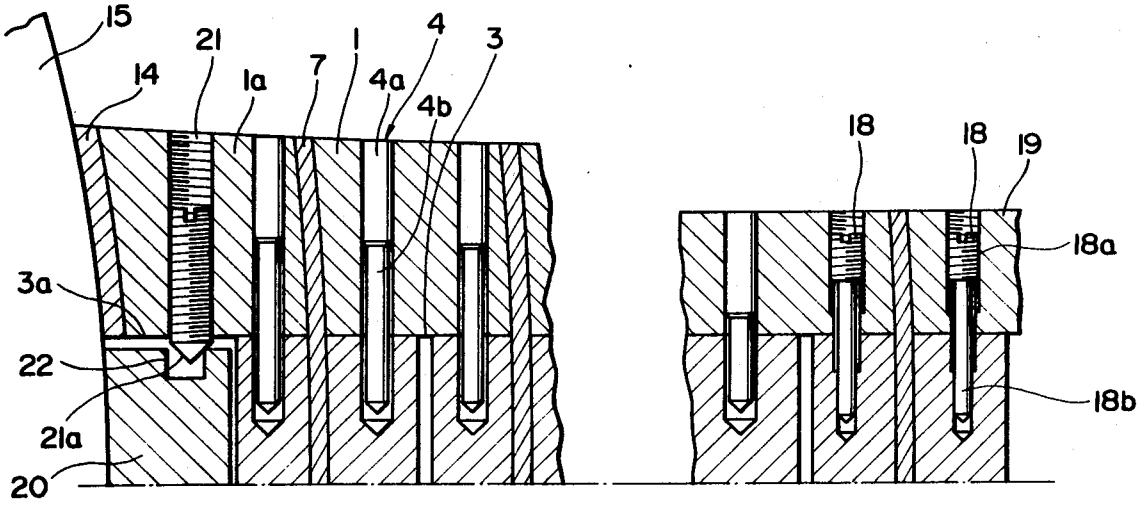

FIG. 7 is an enlarged sectional view of a part of the band.

DESCRIPTION OF THE PREFERRED EMBODIMENTS

Figure 1:
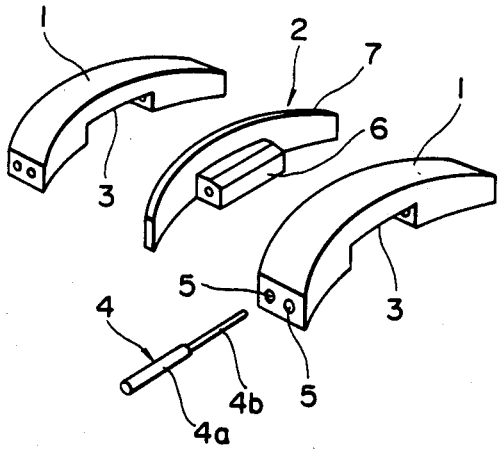
FIG. 1 is an exploded perspective view of a watch band according to the present invention.

Referring to FIG. 1, a watch band according to the present invention comprises a plurality of links 1 each of which is made of solid metal and a plurality of connecting links 2.

Each link 1 has a curved or arcuate quadrate shape in plan view and a semicircular shape as viewed in the longitudinal direction of the band so that an upper surface of the link 1 is slightly upwardly curved. Further, the link 1 has a recess 3 formed in the underside thereof for engaging the connecting link 2. A pair of holes 5 are formed on both sides of the link 1 respectively.

Figure 2:
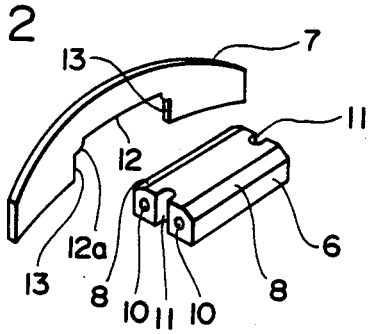
FIG. 2 is an exploded perspective view of a connecting link of the band.
Figure 3:
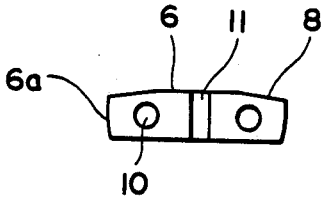
FIG. 3 is a side view of a connecting block.

Referring to FIG. 2, each connecting link 2 comprises a connecting block 6 and a plate member 7 having a recess 12 in the underside thereof. The connecting block 6 is formed to be engaged with the recess 3 of the link 1 and has a pair of beveled end portion 8 at opposite sides of the upper surface thereof in the lateral direction of the band and curved sides 6*a* as shown in FIG. 3 so as to provide a band having flexibility. A pair of holes 10 are formed on opposite sides of the connecting block 6. A pair of vertical grooves 11 are formed on opposite sides of the block 6 between holes 10 corresponding to the recess 12 of the plate member 7. The plate member 7 has a similar semicircular shape to the link 1 and is curved in the same manner as the link 1. Vertical portions 13 of the recess 12 are formed to engage with grooves 11 of the connceting block 6. A pair of projecting portions 12*a* are provided on opposite inside corners of the recess 12 for projection welding.

In order to assemble the parts into a band, first, assembling of the connecting link 2 is done, in such a manner that the recess 12 of plate member 7 is engaged with the connecting block 6, engaging vertical portions 13 with grooves 11. The plate member 7 is secured to the connecting block 6 at projecting portions 12*a* by projection welding so that the connecting link 2 is formed. Then, one side of connecting block 6 of connecting link 2 is engaged with recess 3 of link 1. Connecting pins 4 are inserted into holes 5 and engaged with holes 10, respectively. Each pin 4 has a large diameter portion 4*a* and a small diameter portion 4*b*, the portion 4*a* is secured to hole 5 by force fit and the portion 4*b* is rotatably engaged with hole 10 as shown in FIG. 7. Thus, the link 1 is rotatably connected with the connecting link 2 by the connecting pins 4. The other side of the connecting block 6 is engaged with the other link 1 in the same manner. Thus, a plurality of links 1 and 2 are connected with each other in side by side arrangement as shown in FIG. 6.

FIGS. 4*a* and 4*b* show an end plate 14 for connecting the band to a watch case 15. The end plate has a shape similar to the plate member 7 of the connecting link 2. The end plate 14 has a recess 16 and a pair of projections 17 and, as shown in FIG. 7, is secured to the end link 1*a* by projection welding at the projections 17.

Referring to FIG. 6, several adjusting links 19 in the other end opposite to the watch case 15 are connected by screws 18 (FIG. 7). The screw 18 has a threaded portion 18*a* which is screwed in the link 1 and has an end portion 18*b* which is rotatably engaged with the hole 10 of the connecting block 6. Thus, the length of the band can be adjusted by removing or adding the adjusting links 19.

Referring to FIG. 7, the watch case 15 has a projection 20 for connecting the band, and the projection is inserted into the recess 16 of the end plate 14 and the recess 3*a* of end link 1*a*. A pair of screws 21 are screwed in threaded holes formed in both side portions of end link 1*a* and a conical end 21*a* of each screw 21 is engaged with an inner wall of a hole 22 formed in the projection 20 of the watch case 15. The conical surface of the end 21*a* causes the projection 20 of the watch case 15 to move to the band. Thus, the band is connected to the watch case.

In accordance with the present invention, the connecting link comprises a plate member and a connecting block and the surface of the plate member is exposed between links. The shape of the surface of the plate member can be easily designed. Thus, various patterns of the band can be provided.

While the invention has been described in conjunction with preferred specific embodiments thereof, it will be understood that this description is intended to illustrate and not limit the scope of the invention, which is defined by the following claims.

What is claimed is:

1. A watch band having a plurality of links, and a plurality of connecting links for connecting the links with each other, characterized in that each link has a recess at the underside thereof, each connecting link comprising a plate member and a connecting block which is engaged with recesses of adjacent links, each plate member being secured to each connecting block at a central portion with respect to the width of the band so as to form connecting portions on both sides of the plate member, each link having a pair of holes at both lateral sides thereof, each connecting portion of the connecting block having a hole at both lateral sides thereof, each hole of the connecting portion being so disposed as to correspond to a hole of an adjacent link, said adjacent links being connected by engaging pins with the corresponding holes of the links and the connecting block, and the plate member is so arranged that the surface thereof is exposed between adjacent links at whole width of the band.

2. The watch band according to claim 1, wherein each of the links and plate members has a semicircular shape as viewed lengthwise along the band.

3. The watch band according to claim 1, wherein each of the links and plate members has a curved or an arcuate quadrate shaped surface in plan view.

4. A watch band having a top side and a bottom side and containing a plurality of links and a plurality of connecting links alternately disposed therebetween, each link having a recess which extends across the bottom side thereof, each of said connecting links comprising a plate member with a connecting block which extends laterally from opposite sides thereof, said plate member extending above the top side of the watch band and the connecting block of each connecting link extending into the recesses of adjacent links such that the recess of each link is occupied by the opposing connecting blocks of the adjacent connecting links and means for connecting the connecting links to the links of the watch band.

5. The watch band according to claim 4, wherein the plate member and connecting blocks are separate elements which are assembled by attaching the plate member to the connecting blocks at a central portion with respect to the band width.

6. The watch band according to claim 4, wherein each of the links and plate members has a semicircular shape as viewed lengthwise along the band.

7. The watch band according to claim 4, wherein each of the links and plate members has a curved or an arcuate quadrate shaped surface in plan view.

8. The watch band according to claim 4, wherein holes are provided in lateral portions of said links and in the connecting blocks and said means for connecting the connecting blocks to the links are pins which are inserted through said holes.

9. The watch band according to claim 8, wherein the pins are inwardly inserted into the lateral holes from the outside surface of the link.

10. The watch band according to claim 8, wherein a first lateral hole in the link and a first pin is secured to a block and a second lateral hole in the link and a second pin is secured to a second connecting block.

* * * * *